US007073437B2

(12) United States Patent
Petersen

(10) Patent No.: US 7,073,437 B2
(45) Date of Patent: Jul. 11, 2006

(54) HAND STAMP WITH ADHESIVELY HELD INK CARTRIDGE

(76) Inventor: Craig J. Petersen, 410 Meacham, Park Ridge, IL (US) 60068

( * ) Notice: Subject to any disclaimer, the term of this patent is extended or adjusted under 35 U.S.C. 154(b) by 0 days.

(21) Appl. No.: 10/769,641

(22) Filed: Jan. 30, 2004

(65) Prior Publication Data

US 2005/0166776 A1 Aug. 4, 2005

(51) Int. Cl.
*B41K 1/052* (2006.01)

(52) U.S. Cl. ..... 101/333; 101/401.1; 101/405

(58) Field of Classification Search ..... 101/333, 101/401.1, 405
See application file for complete search history.

(56) References Cited

U.S. PATENT DOCUMENTS

| | | | | |
|---|---|---|---|---|
| 2,427,447 | A * | 9/1947 | Dicks | 101/128.21 |
| 3,172,356 | A * | 3/1965 | Vosburg | 101/125 |
| 3,277,819 | A * | 10/1966 | Berkland | 101/125 |
| 3,335,660 | A * | 8/1967 | Vosburg | 101/125 |
| 3,832,947 | A * | 9/1974 | Funahashi | 101/327 |
| 5,303,647 | A * | 4/1994 | Seo et al. | 101/125 |
| 5,577,444 | A | 11/1996 | Toyama | |
| 5,899,142 | A * | 5/1999 | Suda et al. | 101/125 |
| 5,942,312 | A | 8/1999 | Venkataraman et al. | |
| 5,996,493 | A | 12/1999 | Okumura et al. | |
| 6,164,202 | A | 12/2000 | Takami | |
| 6,189,450 | B1 * | 2/2001 | Shih | 101/327 |
| 2004/0168590 | A1 * | 9/2004 | Petersen | 101/333 |

* cited by examiner

*Primary Examiner*—Andrew H. Hirshfeld
*Assistant Examiner*—Jill E. Culler
(74) *Attorney, Agent, or Firm*—Knechtel, Demeur & Samlan

(57) ABSTRACT

A hand stamp that has a frame member that holds an ink cartridge. The cartridge has an ink storage layer and an image forming layer. There is a ledge surrounding the inside of the frame member that has an adhesive applied to it. The ink storage layer is attached to the frame member by the adhesive. There is an ink entrance hole in the frame into which is poured the printing ink. A plurality of baffles within the frame member control the speed at which the ink disburses throughout the ink storage layer thereby keeping the ink from saturating the adhesive that is used to hold the ink cartridge in place.

10 Claims, 2 Drawing Sheets

HAND STAMP WITH ADHESIVELY HELD INK CARTRIDGE

BACKGROUND AND SUMMARY OF THE INVENTION

This invention relates to hand stamps and more particularly to a self-inking hand stamp that does not require a stamp pad. The hand stamp utilizes a porous foam and an ink cartridge mounted together in intimate contact with each other to create the printing aspect of the device. The porous foam has the image forming stamp material on its surface. This invention also relates to the design and manufacture of the stamp frame that adhesively holds the porous foam and ink cartridge to the stamp frame.

Many conventional stamps require manufacturing the printing surface from rubber or other flexible material. The printing surface is securely mounted on a handle that is grasped by the user. The printing surface is placed into contact with an inkpad where ink transfers to the printing surface. The inked printing surface is then pressed against the surface onto which the stamp image is to be transferred. Repetition of the stamping process requires that the printing surface be pressed against the inkpad each time an image is to be transferred. This is a disadvantage to the user as it requires extra time for each re-inking step and slows down the stamping process if multiple stampings are to be done. It also requires the use of a separate inkpad that must be periodically re-inked.

An improved stamp was developed that uses a printing surface made from an ink permeable material that allows ink to pass from an ink reservoir, through the printing surface and onto the object being marked. This eliminated the need for a separate stamp inkpad. These stamps are referred to as hand stamps. There is no simpler stamping device to transfer images than the hand stamp.

An example of this stamp is illustrated in U.S. Pat. No. 5,577,444 issued to Toyama. This patent illustrates a hand stamp that has a sealed ink compartment that stores the ink. The ink can be refilled into the compartment by means of removing a threaded screw at the top of the compartment. Once the screw is removed, the ink can be injected, and the screw replaced. The stamping member has a stamping surface with stamping and non-stamping portions. The stamp pad is fixed to the stamp frame at the factory and is not designed to be field installed or removed.

There are several problems with this device. First, the porous foam or printing surface is factory sealed. If an error is made during manufacturing, the entire mount must be thrown away, thus increasing costs. Since it is factory sealed, a special machine is required to expose the porous foam to form the image on the porous foam surface.

Another type of stamp is illustrated in U.S. Pat. No. 5,942,312 issued to Venkataraman et al. This patent discloses a pre-inked thermoplastic foam which has open cells in the area that is designed to transfer ink and closed or sealed cells in the area which is designed to be impermeable to ink. The pre-inked thermoplastic foam is pre-inked before the image is formed on the thermoplastic material. Thus if there is a problem with the image, the entire pad including the ink, is wasted. Furthermore there may be difficulties in forming an image on a pre-inked thermoplastic foam as it may be messy or require special handling due to the ink in the pre-inked thermoplastic foam. The pre-inked thermoplastic foam is mechanically held to the stamp and assembled at the factory. The pre-inked thermoplastic foam is not designed to be installed or removed in the field.

U.S. Pat. No. 5,996,493 issued to Okumura et al. illustrates a pre-inked stamp that uses an ink pack to supply ink to the porous stamp. The ink pack ruptures when the ink pack is pressed against a cutting device in the stamp. There is a transparent film thermally attached to the stamp surface to protect the stamp surface during transport and storage. The transparent film is removed just before using the stamp for printing images. The porous stamp portion is thermally attached to the holder at the factory and is not designed to be installed in the field.

Another stamp is disclosed in U.S. Pat. No. 6,164,202 issued to Takami. This patent discloses a stamp unit comprising a holder, which is placed in a stamp manufacturing device for making a stamping surface on a stamp material. The holder interacts with the stamp manufacturing device to properly position the holder in the manufacturing device. An image is formed on the surface of the stamp forming material by fusing portions on the surface. The stamp forming material is saturated with ink and ink is allowed to flow out from the non fused portions onto a printing sheet forming the image.

A problem not solved by the prior art devices is providing an ink cartridge and stamp in a self contained easy to use unit. Also, the method of manufacturing a hand stamp with an adhesively held ink cartridge was never taught.

A characteristics of the prior art devices is that the stamp forming material with the image to be transferred thereon was held in place in the stamp by means of a trim ring or other mechanical grasping means that generally extended around the circumference of the stamp forming material. When the stamp is assembled, the trim ring snaps into place holding the stamp forming material within the stamp frame. In other devices the stamp forming material is attached to the stamp frame at the factory in such a way that it could not be attached in the field. It would be desirable if the stamp forming material could be held in place by adhesive, thus eliminating one component of the stamp. This would also reduce the cost of the stamp. It would also be desirable if the attachment of the stamp pad to the frame could be done in the field so that expensive equipment and added manufacturing costs could be eliminated.

Applicant's invention addresses and solves the problems of the prior art devices. The invention comprises an ink cartridge that has an ink storage layer or cartridge and a porous foam layer with an image forming stamp material on the surface. The two layers are in intimate contact with each other and are designed for mounting in a hand stamp. The hand stamp has a handle, which is grasped by the user. The image forming stamp material is a porous foam material and has an outer surface made of a porous resin layer. Portions of the porous resin layer are melted and solidify into impermeable areas that are ink impermeable, and other portions of the porous resin layer remain unmelted and allow ink to pass. In this manner the stamping image is defined.

A frame member has a top, a bottom and side walls. There is a ledge at the bottom that has adhesive applied to it. The ink cartridge is affixed to the ledge by means of the adhesive. At the top of the frame member are ink receiving holes. There is a plurality of baffle members inside of the frame that form a circuitous path from the ink entrance holes to the ledge. In this manner the flow of ink is controlled from the ink receiving holes to the ledge causing the area where the ink cartridge is affixed to the ledge to remain unsaturated with ink. This results in the adhesive maintaining the bond between the ink cartridge and the ledge.

OBJECTS AND ADVANTAGES

It is an object to provide a hand stamp that uses an inventive frame member that has a ledge portion with adhesive thereon to securely retain an ink cartridge to the frame. It is a related object to provide an ink cartridge having an ink storage layer and an image forming layer.

Still another object is to provide a hand stamp that uses a frame member that has an ink receiving hole in the top of the frame and a plurality of baffles inside of the frame to control the flow of ink inside of the frame member to and across the ink storage layer. A related object is to use printing ink supplied from a bottle to saturate the ink storage layer as this type of ink is generally less expensive than other types of printing inks.

One advantage of this invention is that it allows the ink cartridge to be affixed to the frame member by means of adhesive instead of the traditional retaining or trim ring. This eliminates one of the parts of previous stamps resulting in lower cost and ease of manufacturing and assembling the stamp. This also eliminates the need for factory sealing the ink cartridge or ink storage reservoir.

Another advantage is that the invention uses current image forming technology and applies it to the least expensive and most simple type of hand stamp.

These and other objects and advantages will be apparent from reviewing the following Description of the Drawings and Description of the Preferred Embodiment.

DESCRIPTION OF THE PREFERRED EMBODIMENT

Figure 1:
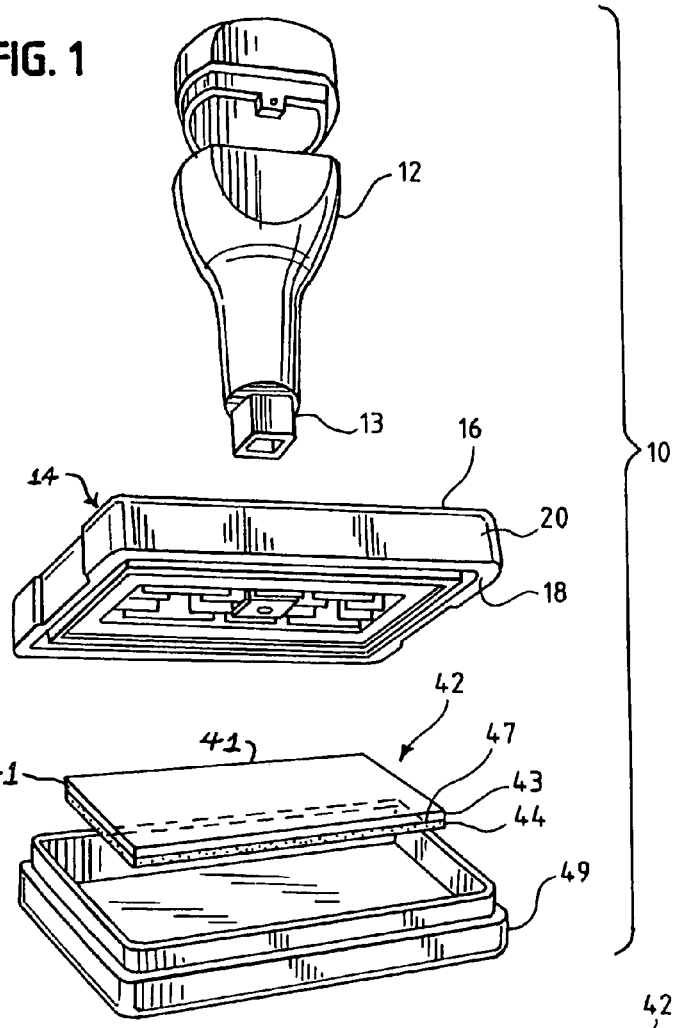
FIG. 1 is an exploded perspective view of a hand stamp illustrating the orientation of the various parts of the stamp and the inventive frame member.

Turning to FIG. 1 there is illustrated a hand stamp 10, which utilizes the present invention. The stamp 10 does not require the use of a separate, stand alone inkpad that is not a part of the hand stamp 10. There is a handle 12 designed to be grasped by the user. There is a square base 13 at a bottom portion of the handle 12.

Figure 4:
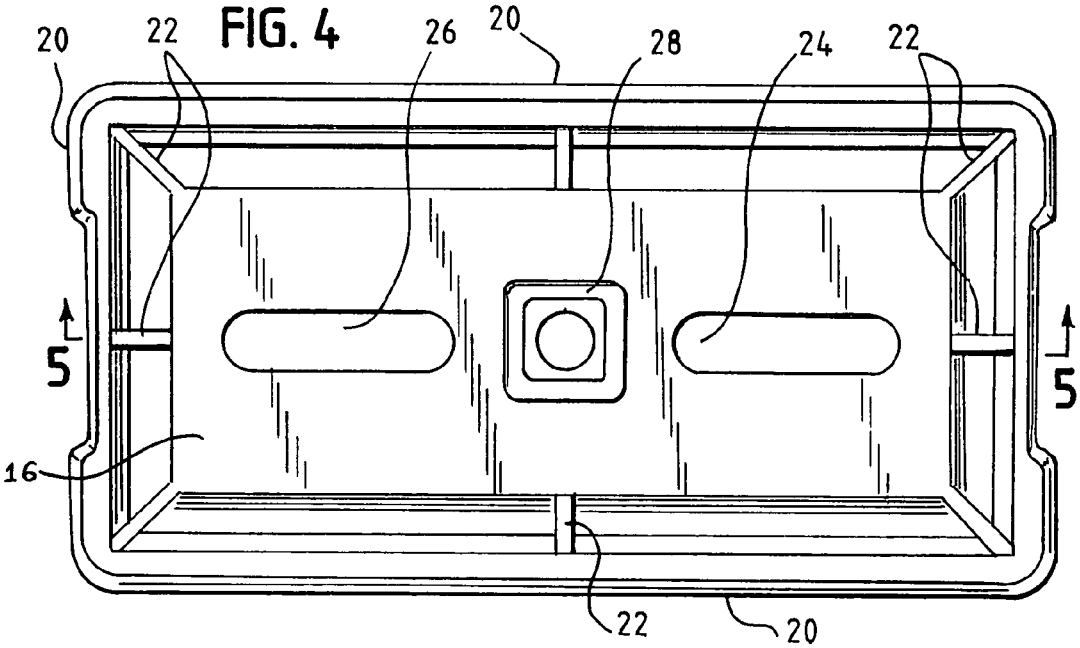
FIG. 4 is a top view of the frame member.

A frame member 14 has a top 16, a bottom 18, and side walls 20 that enclose a frame cavity 21. The frame member 14 is illustrated as rectangular as this is the most common stamp configuration, although other geometric shapes such as square or circular can also be used. As seen in FIG. 4 the frame member 14 has support ribs 22 that provide structural support by joining the top 16 to the side walls 20. There are two ink entrance holes 24 and 26 through which ink is poured as will be described later. There is a square receiving hole 28 centrally disposed in the frame member 14 which receives in frictional engagement the square base 13 of the handle 12. This joins the handle 12 to the frame member 14.

Figure 3:
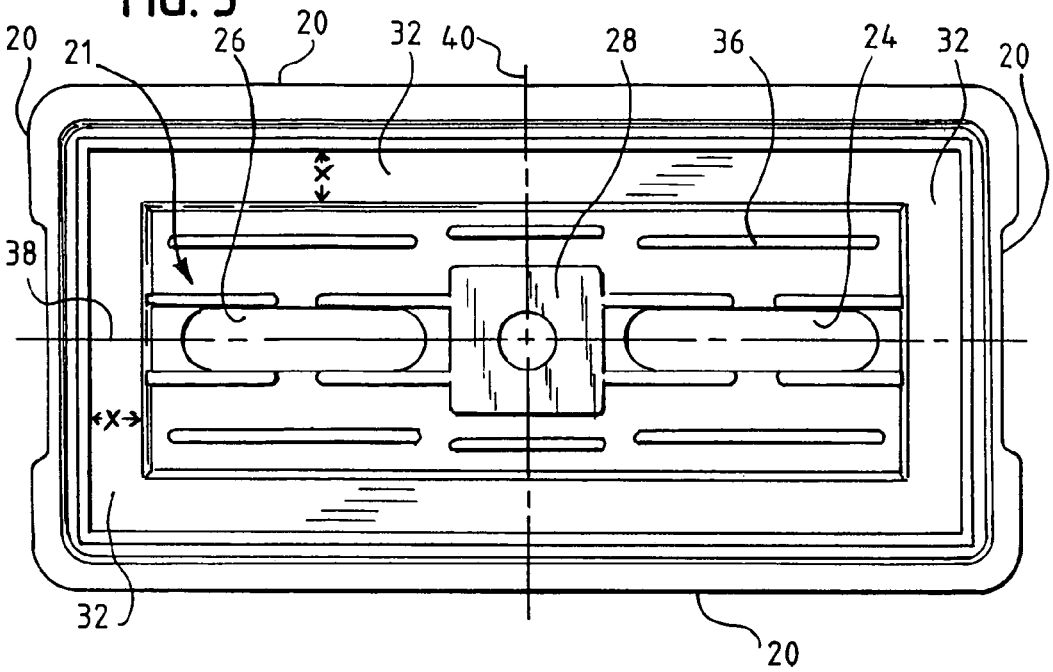
FIG. 3 is a bottom view of the frame member illustrating the ledge and baffle members.

The bottom 18 of the frame member 14 is illustrated in FIG. 3. There is a ledge 32 that extends around the entire perimeter of the frame member 14 inside of the frame cavity 21. The ledge 32 extends a distance "x" from the side walls toward the centrally disposed receiving hole 28. An adhesive 34 is applied to the ledge 32 and covered with a removable covering (not illustrated). Alternatively a double sided tape is applied to the ledge with one side of the tape exposed and affixed to the ledge 32 and the other side of the tape left covered until ready for use. Another alternative is applying liquid glue to the ledge 32.

A plurality of baffle members or plates 36 are mounted inside of the frame cavity 21. The baffle members 36 extend vertically downward from the top 16 to a point above the bottom 18. The baffle members 36 and ink entrance hole 26 are symmetrical about a horizontal center line 38 and vertical center line 40, both shown in phantom.

As seen in FIG. 1 there is an ink cartridge 42 with an outer edge 41 surrounding it. The ink cartridge 42 is comprised of an ink storage layer 43 and image forming layer 44 that has an image surface 46. This is the printing side or stamp surface. There is also an opposite non-printing side 47 that is in intimate contact with the ink storage layer 43. The image forming layer 44 is made from a porous soft resin in which optical energy absorbing material is dispersed. To produce an image 45 onto the image surface 46, a transparent film having the positive image to be created is placed against the image surface 46. The image is normally comprised of black and clear areas. With the transparent film with the image thereon against the image surface 46, the ink cartridge 42 is placed in a sealed light box with the image surface 46 pressed against a clear glass or plastic member. A xenon light is placed in the light box below the image surface 46 and energized for a predetermined time. The rays from the xenon light irradiate the image surface 46 through the transparent film wherever there were clear image areas. This causes a chemical reaction fusing the foam from the heat. This seals what were the clear areas resulting in areas that are non-permeable to the ink passing through the image forming layer 44. The rays do not penetrate the black image areas on the film and thus no reaction occurs on the image surface 46. These areas remain unsealed and thus ink permeable. Thus, the image 45 is formed. Machinery for this stamp forming process is available in the industry. Other methods to form the image 45 on the image forming layer 44 are available which provide ink permeable and ink impermeable areas to define the image.

The stamp 10 when completely assembled has a bottom cover 49 that snaps onto the bottom of the frame member 14. This covers the image forming layer 44 so that the image or ink is not accidentally transferred to surfaces or objects that are not intended to receive the image. The cover 49 is snapped off and exposes the image surface 46 when the stamp 10 is to be used.

Figure 2:
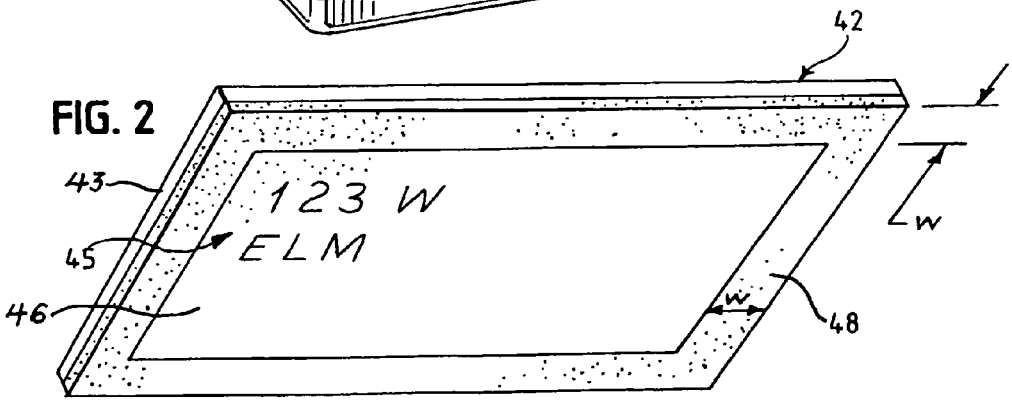
FIG. 2 is a bottom perspective view of the ink cartridge showing the image forming layer with an image thereon.

As seen in FIG. 2, the image forming layer 44 has the image 45 formed thereon as previously described. The image can be alpha-numeric designators, pictures, graphs, etc. There is a border area 48 that frames the image forming layer 44. None of the image 45 is intended to be in the border area 48. In fact, the border area 48 is preferably intended to not have any ink in this area. A width "w" of the border area 48 is substantially the same as the width "x" of the ledge 32.

Figure 5:
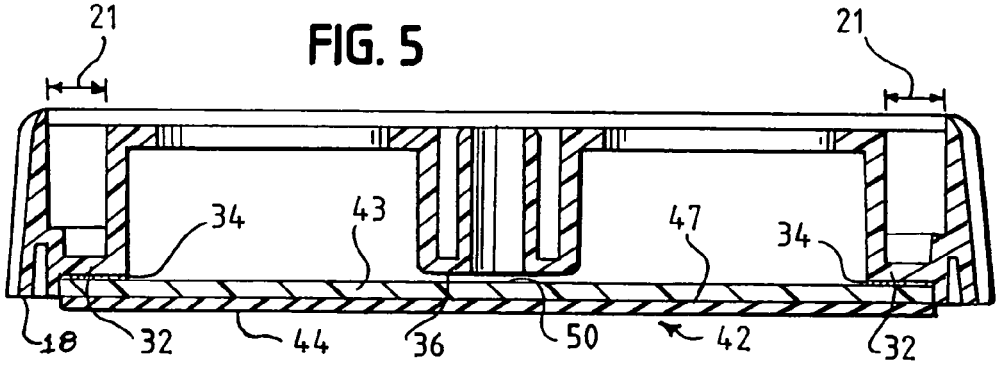
FIG. 5 is an enlarged cross sectional view with portions removed of the assembled frame member and ink cartridge.

As seen in FIG. 5, the ink cartridge 42 has the border area 48 on its ink storage layer 43. The ink storage layer 43 is attached to the ledge 32 by means of the adhesive 34. In this manner the ledge 32 supports the edges of the ink cartridge 42. The ink cartridge 42 is dimensioned so that it is snugly received within the perimeter of the ledge 32 with the image forming layer 44 extending slightly below the bottom 18. This allows the image forming layer 44 to be retained within the frame member 14 yet allows the image forming layer 44 to extend below the bottom 18 of the frame member 14 for printing.

Once the image is formed on the image forming layer 44 and the ink cartridge 42 is securely attached to the ledge 32, the ink cartridge 42 is loaded with ink. This is done by the user pouring, injecting or dripping a predetermined quantity of printing ink into the ink entrance holes 24, 26. The baffles 36 have their bottoms slightly above the ink storage layer 43. The ink flows between a gap 50 defined by the bottoms of the baffles and the top of the ink storage layer 43. The positions of the baffles 36 form a circuitous path from the ink entrance holes 24, 26 toward the ledge 32 surrounding the inside of the frame member 14. The ink flows from the ink entrance holes 24, 26 toward the ledge 32. Ideally the ink will saturate the ink storage layer 43 in the area framed by the ledge 32, but not saturate the area "w" where the ink cartridge 42 is fastened to the ledge 32. If the area between the ledge 32 and the ink storage layer 43 is saturated with ink, it will compromise the adhesive bond that retains the ink cartridge 42 to the ledge 32. Thus there is a balance that must be achieved so that the flow of the ink through the circuitous path achieves the desired result. The ink flow rate and area saturated is determined by the circuitous path, the height of the gap 50, the viscosity of the ink and the characteristics of the ink storage layer 43 and image forming layer 44. Preferably the ink storage layer 43 and image forming layer 44 direct the flow of ink vertically through the medium and do not enhance the lateral flow of ink toward the border area 48 of the ink cartridge 42. This assists in keeping the flow of ink vertical instead of horizontal and thus minimizes the flow or saturation of ink under the ledge 32. The ink viscosity is determined by the selected characteristics of the ink preferred by the stamp manufacturer. The flow of ink through the ink storage layer 43 and image forming layer 44 is a characteristic of the particular materials from which these layers are manufactured. By varying the gap 50 and location and dimensions between adjacent baffles, the ink flow rate to the border area 48 is controlled.

When no ink remains in the cartridge 42 or when the ink storage layer 43 and image forming layer 44 dry out, the ink cartridge 42 can be re-inked. This is accomplished by merely pouring the predetermined quantity of ink into the ink entrance holes 24 and 26. The ink flows through the baffles and into the ink storage layer 43 as previously described Thus there has been provided a hand stamp that does not require a stamp pad and in which the porous foam and ink cartridge are mounted together in intimate contact with each other. The resultant hand stamp fully satisfies the objects and advantages set forth herein. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A hand stamp unit comprising:

an ink cartridge having an ink storage layer and an image forming layer, the image forming layer having an outer surface that is selectively sealable to form ink impermeable areas and ink permeable areas thereby creating an image, the ink cartridge having an outer edge and a border area adjacent to the outer edge on the ink storage layer, the border area of the ink cartridge forming a non-ink storage area surrounding the ink storage layer, a frame member having a top, a bottom and side walls, an ink entrance hole at the top of the frame member, a ledge extending inward from the side walls, a plurality of baffle members mounted within the frame member, the baffle members forming a circuitous path from the ink entrance hole to the ledge for controlling the flow of ink from the ink entrance hole to the ledge, and an adhesive applied between the ledge and the border area for affixing the border area of the cartridge to the ledge.

2. The hand stamp unit of claim 1 and further comprising a handle attached to the frame member.

3. The hand stamp unit of claim 2 and further comprising a removable cover sheet that covers the adhesive until the ink cartridge is to be attached to the ledge at which time it is removed thereby exposing the adhesive.

4. The hand stamp of claim 2 wherein the adhesive is a liquid glue.

5. The hand stamp unit of claim 1 wherein the ink storage layer and image forming layer are bonded to each other.

6. The hand stamp unit of claim 1 wherein the ink entrance hole is in fluid communication with the circuitous path.

7. The hand stamp unit of claim 6 and further comprising a second ink entrance hole at the top of the frame member in fluid communication with the circuitous path.

8. The hand stamp unit of claim 1 wherein the baffle members are support members for adding structural strength to the frame member.

9. The hand stamp unit of claim 1 wherein the baffle members are symmetrically mounted on either side of the frame member about a horizontally disposed center line.

10. The hand stamp unit of claim 1 wherein the baffle members are symmetrically mounted on either side of the frame member about a vertically disposed center line.

* * * * *